US006916107B2

(12) United States Patent
Munson

(10) Patent No.: US 6,916,107 B2
(45) Date of Patent: Jul. 12, 2005

(54) APPARATUS AND METHOD FOR SAFE ILLUMINATION OF FINE ART WORKS

(76) Inventor: David Munson, 1236 Wood Station Pl., St. Louis, MO (US) 63021

( * ) Notice: Subject to any disclaimer, the term of this patent is extended or adjusted under 35 U.S.C. 154(b) by 102 days.

(21) Appl. No.: 10/613,360

(22) Filed: Jul. 3, 2003

(65) Prior Publication Data

US 2005/0002192 A1 Jan. 6, 2005

(51) Int. Cl.[7] ..... F21V 13/14

(52) U.S. Cl. ..... 362/293; 362/307; 362/277; 362/319

(58) Field of Search ..... 362/307, 293, 362/277, 280, 319, 320, 333, 332, 339, 327, 328, 147

(56) References Cited

U.S. PATENT DOCUMENTS 1,466,358 A * 8/1923 Erickson ..... 362/309
4,482,942 A * 11/1984 Blaisdell et al. ..... 362/293
5,115,380 A * 5/1992 Huisingh et al. ..... 362/333
5,161,885 A * 11/1992 Segaud et al. ..... 362/332
5,727,868 A * 3/1998 Sharma ..... 362/147
5,934,787 A 8/1999 Sharna

* cited by examiner

*Primary Examiner*—Sandra O'Shea
*Assistant Examiner*—Bao Q. Truong
(74) *Attorney, Agent, or Firm*—Husch & Eppenberger, LLC; H. Frederick Rusche

(57) ABSTRACT

A lighting system for illuminating artwork includes a housing; a lamp mounted within the housing and including a halogen bulb and a reflector, said reflector having a dichroic coating; a linear spread lens positioned in front of the lamp, said lens having an etched first portion and a lighter etched second portion of a first surface, and said lens further having a color-adjusting tint and an ultraviolet filter coating; and a door associated with the housing directing the light emitted by the lighting system through the linear spread lens. The resulting lighting system produces safe light diffused evenly substantially over the entire surface of a piece of artwork.

18 Claims, 6 Drawing Sheets

APPARATUS AND METHOD FOR SAFE ILLUMINATION OF FINE ART WORKS

FIELD OF THE INVENTION

This invention relates generally to lighting systems and, more particularly, to a system for safely and effectively illuminating light-sensitive artwork.

BACKGROUND OF THE INVENTION

The lighting of artwork in museums has traditionally been done by gallery style lighting in which a series of individual lights are mounted on a track and aimed at the artwork with overlapping beam patterns. These lights are located on the ceiling or placed high above the artwork to reduce radiant heat and are normally shielded with a UV reducing filter. These systems work well in commercial spaces but are highly undesirable and impractical in residential settings.

The lighting of art from picture lights is traditionally done with exposed incandescent lamps located in a metal housing that can be rotated to direct the light onto the artwork and prevent direct glare into the viewers eyes. The exposed incandescent lamp generates light by heating the filament to "incandescence", thereby exposing the artwork to excessive heat. Additionally, these lamps do not properly illuminate the artwork in an even manner.

The prior art also includes fluorescent lamps. Fluorescent sources offer the benefit of producing less heat than incandescent lamps. However, these lamps also produce high levels of damaging UV rays. Furthermore, fluorescent lamps have difficulty evenly lighting an entire artwork due to poor reflector designs and socket shadows occurring between multiple lamps.

Halogen based lamps are another alternative light source. Halogen light sources generate large amounts of heat and some UV rays. Halogen lights are available in various wattages. Some halogen lamps, referred to as MR style lamps, are provided with precise mirrored reflectors. These lamps can produce round, narrow beam distribution that can illuminate the entire height of a piece of art. However, MR lamps generally produce round beams of light down an artwork that are difficult to distribute evenly across the width of the work, particularly when the light sources are mounted close to the artwork.

Recent advances in the prior art include the use of bare halogen lamps in combination with framing shutters or aperture plates. These systems include a single, small light source and limit the projection of light to the area of the canvas. These systems are limited by the fact that the lamp must be mounted at a significant distance out from the artwork in order to evenly illuminate a large piece of art. Examples of these systems are manufactured by DeBruyne Lighting LLC of Florida and Hogarth Fine Art Lighting of England. The system manufactured by DeBruyne includes a UV filter manufactured by Optivex. However, this filter only removes a portion of the harmful UV spectrum. The Hogarth system uses a lamp with a reduced UV ray output rather than a filter. Neither system offers any means of limiting the amount of radiant heat generated by the system. These systems are not generally suitable for lighting larger artworks.

Light generated by most light sources, such as round halogen and incandescent exposed lamps, is not naturally collimated in the direction of propagation of the light on artwork. Collimation of multiple halogen light sources is often desirable to achieve high color rendering or artwork but is normally combined with excessive radiant heat or damaging UV light.

Furthermore, MR style lamps have a circular cross-section. Thus, the generated light beam also has a circular cross-section. Where it is desired to generate a light beam having other than a circular cross-section (e.g., rectangular cross-section) the light beam cannot be efficiently transformed from a circular to non-circular shape.

The present invention is directed to overcoming one or more of the problems set forth above.

SUMMARY OF THE INVENTION

An aspect of the present invention is to provide a system for safely and effectively lighting artwork without exposing the artwork to excessive levels of radiant heat or ultraviolet light.

Another aspect of the present invention is to provide a system for lighting artwork that results in a more even distribution of light covering the entire area of the artwork.

In accordance with the above aspect of the invention, there is provided a lighting system for illuminating artwork that includes a housing; a lamp mounted within the housing and including a halogen bulb and a reflector, said reflector having a dichroic coating; a linear spread lens positioned in front of the lamp, said lens having an etched first portion and a lighter etched second portion of a first surface, and said lens further having a color-adjusting tint and an ultraviolet filter coating; and a door associated with the housing directing the light emitted by the lighting system through the linear spread lens. The resulting lighting system produces safe light diffused evenly substantially over the entire surface of a piece of artwork.

In accordance with yet another aspect of the invention, there is provided an associated method of optically correcting a beam of light emitted by a halogen light source for illumination of artwork that includes the steps of emitting a beam of light from a halogen bulb; filtering radiant heat from the beam of light through a reflector surrounding the halogen bulb and having a dichroic coating; laterally diffusing the beam through a linear spread lens positioned in front of the lamp; vertically diffusing the beam through an etched first portion and lighter etched second portion of said lens; and adjusting the color of the beam through a tinted coating on the lens.

These aspects are merely illustrative of the innumerable aspects associated with the present invention and should not be deemed as limiting in any manner. These and other aspects, features and advantages of the present invention will become apparent from the following detailed description when taken in conjunction with the referenced drawings.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION OF THE PREFERRED EMBODIMENTS

Figure 1:
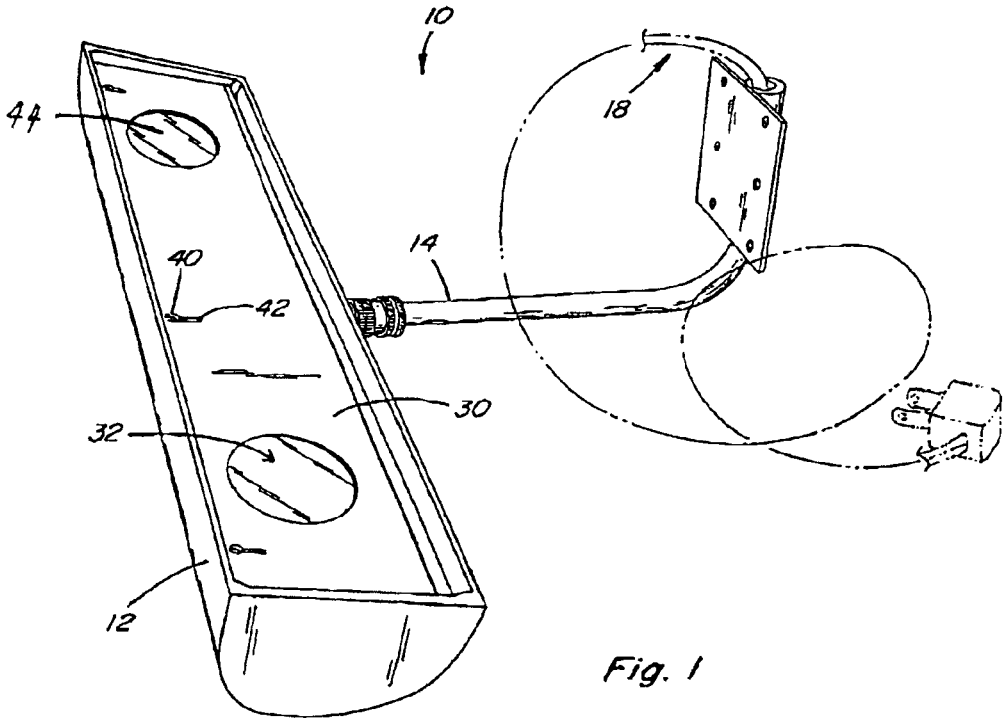
FIG. 1 is a perspective view of a lighting system for illuminating artwork according to one embodiment of the present invention.

In the following detailed description numerous specific details are set forth in order to provide a thorough understanding of the invention. However, it will be understood by those skilled in the art that the present invention may be practiced without these specific details. For example, the invention is not limited in scope to the particular type of industry application depicted in the figures. In other instances, well-known methods, procedures, and components have not been described in detail so as not to obscure the present invention.

FIGS. 1–4 illustrate a light for illuminating artwork 10. The light 10 includes a housing 12 and a mounting arm 14, by which the light 10 can be mounted to a piece of art, such as a frame surrounding a painting, or a wall adjacent the piece of art. The housing 12 may be arranged in a variety of cross-sectional shapes, including rounded or square, and colors, and has a open surface on one side. The housing 12 may be constructed of aluminum, steel, brass, plastic or any other suitable, rigid material. For most artworks, the mounting arm 14 advantageously positions the housing normally about 5 to 9 inches out from the artwork being illuminated, depending on the height of the work, and aims the lamps 24 (discussed in more detail below) ⅔ to ¾ of the way down the work. The light 10 may also be mounting at the bottom of an artwork, in which case, the lamps 24 would be aimed about ⅔ to ¾ of the way up the artwork.

A socket holder 16 is supported within the interior of the housing 12. The socket holder 16 is advantageously constructed of an extruded aluminum material, however, any rigid material is suitable. The socket holder 16 supports at least one light source 22.

Figure 2:
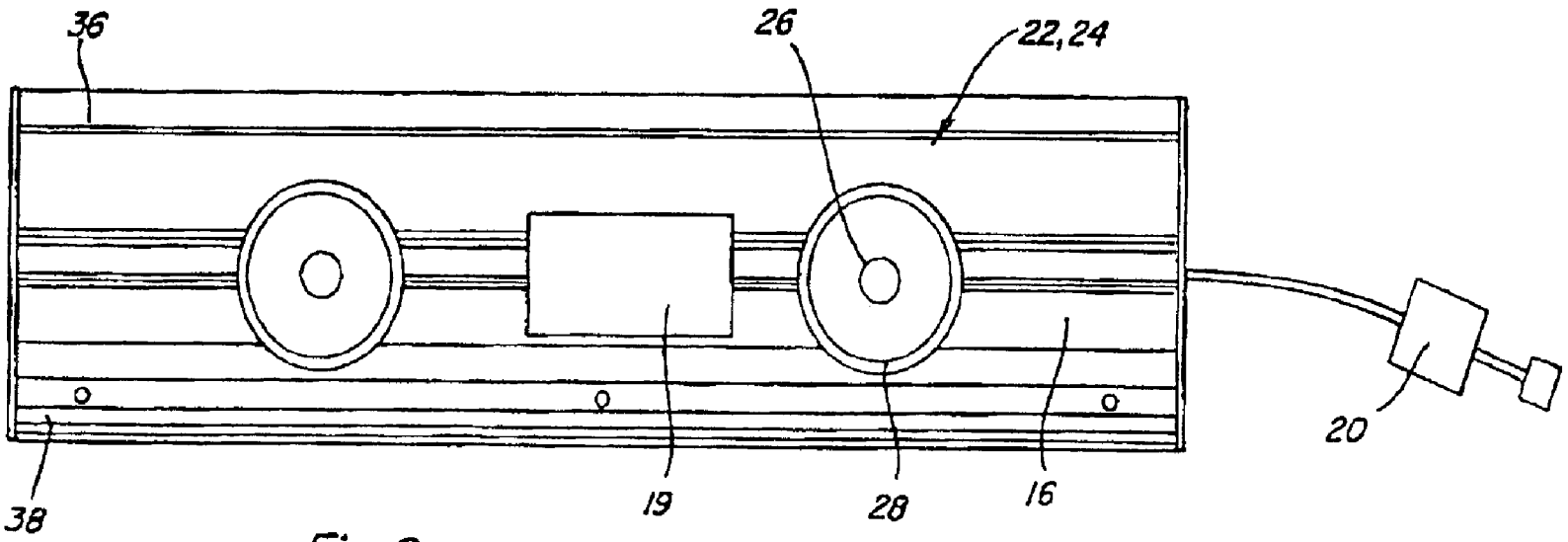
FIG. 2 is a schematic view of the underside of a lighting system for illuminating artwork according to another embodiment.
Figure 3A:
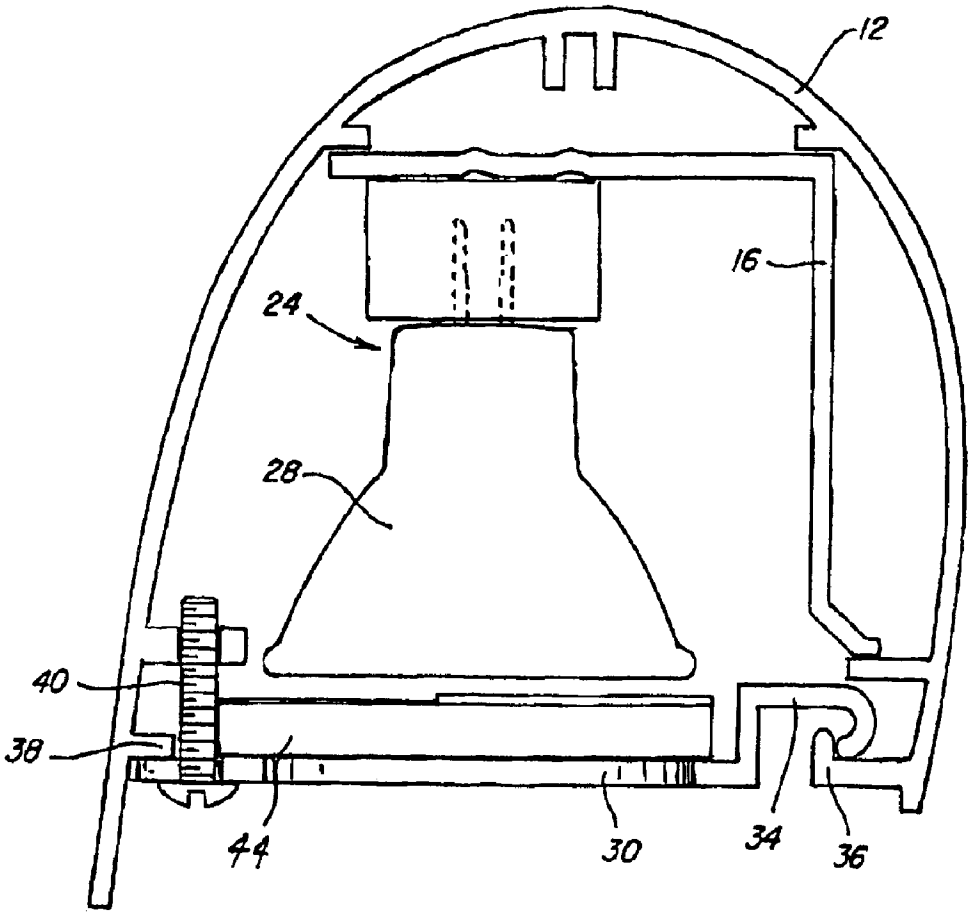
FIG. 3A is a cross-sectional view of the lighting system of FIG. 2, taken along line A—A.
Figure 3B:
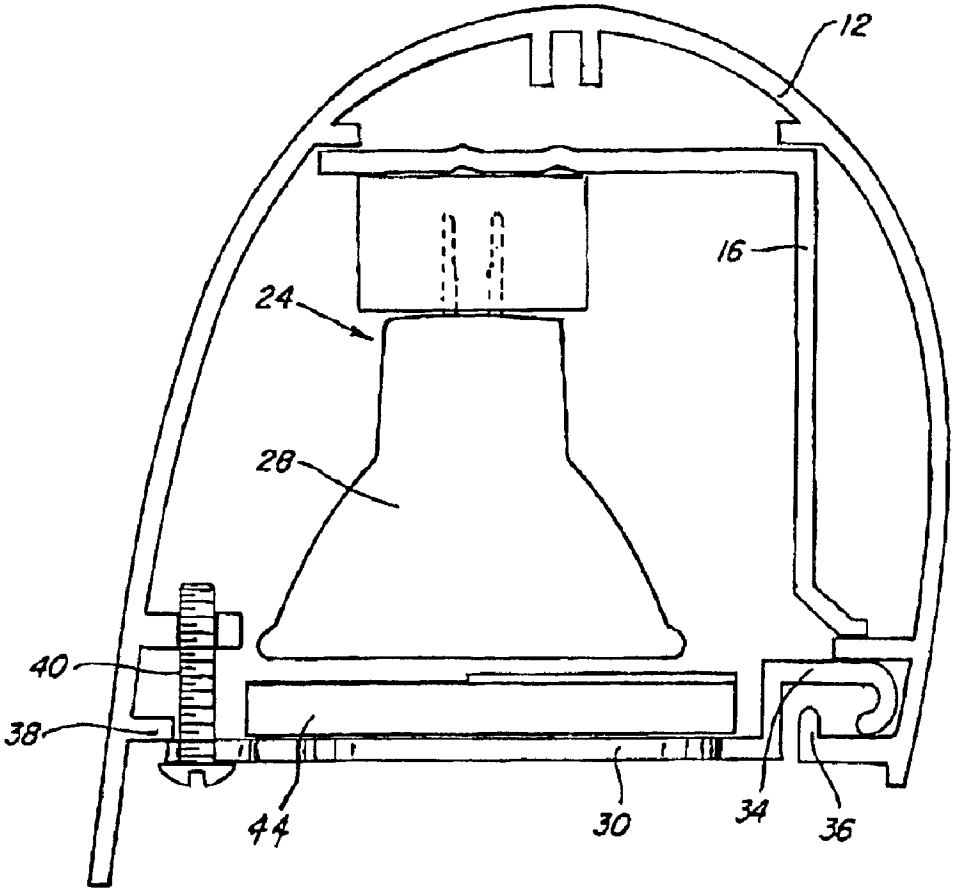
FIG. 3B is a cross-sectional view of the lighting system of FIG. 2, taken along line A—A, showing the hinged door in a shifted position.
Figure 4A:
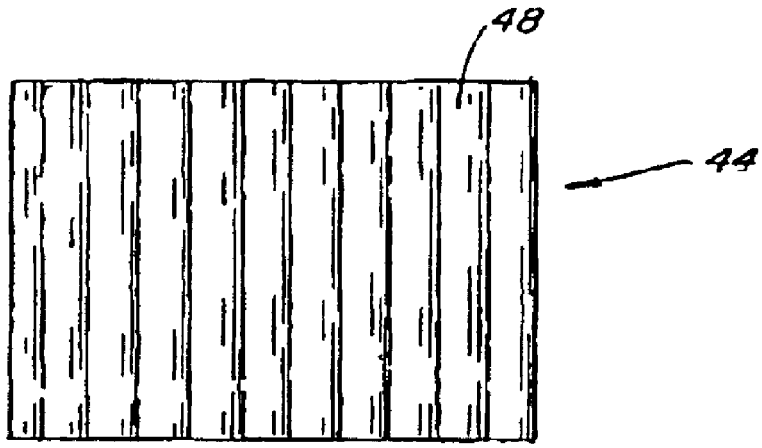
FIG. 4A is a top view of a linear spread lens suitable for use in a lighting system for illuminating artwork according to another embodiment.
Figure 4B:
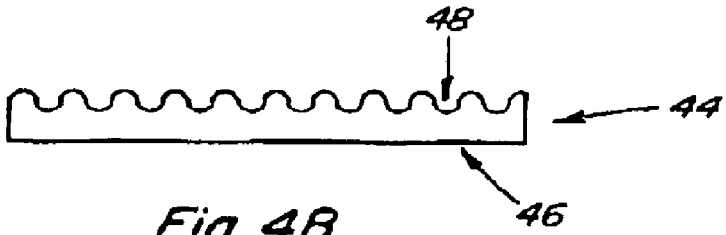
FIG. 4B is a side view of the linear spread lens of FIG. 4A.
Figure 4C:
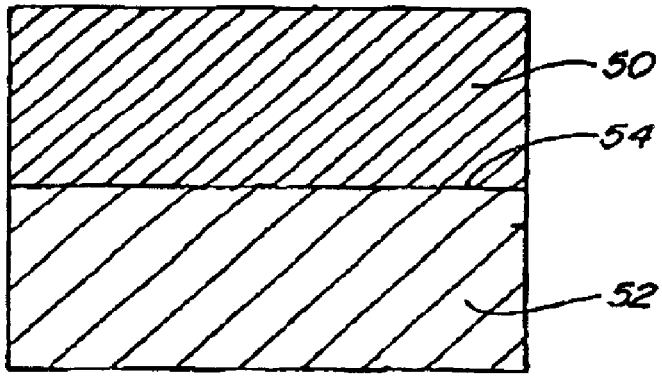
FIG. 4C is a bottom view of the linear spread lens of FIG. 4A.
Figure 5:
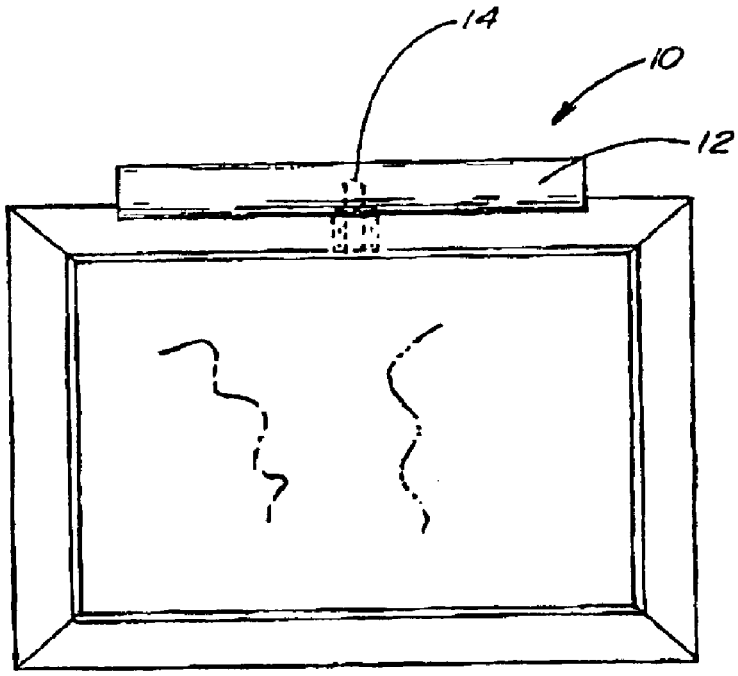
FIG. 5 is a schematic view of a lighting system for illuminating artwork installed above a painting.

The light 10 also includes a power source 18. The power source 18 shown in FIGS. 1–3 is a standard 110V AC power cord that may be plugged into any standard outlet. The power source may include a transformer 19. The transformer 19 may be located within the housing 12 or integrated with a power cord. In an alternate embodiment, the power source 18 includes a battery of suitable voltage. The light 10 may also be hardwired into an existing electrical circuit.

The light 10 may also include a light switch 20. The light switch 20 may be a simple on/off contact switch to control the flow of electricity to the light source 22 or, alternatively, a dimmer switch to adjust the amount of light emitted by the light source 22.

The light source 22 itself may consist of any number of single point lamps 24, depending on the width of the light required, which is generally dictated by the width of the artwork to be illuminated. If multiple lamps 24 are used, they are preferably spaced 7 to 12 inches from one another. Advantageously, the lamps 24 are halogen narrow beam lamps consisting of a halogen bulb 26 and a reflector 28. In a particularly preferred embodiment, the halogen bulb 26 is a low wattage MR-11 halogen bulb. The reflector 28 is provided with a dichroic coating that allows all long wave radiation, including radiant heat, to pass through the reflector rather than being reflecting out of the lamp 24 and onto the artwork being illuminated. This significantly reduces the amount of radiant heat to which the artwork is subjected.

A hinged door 30 is provided to substantially enclose the open side of the housing 12. The hinged door 30 is provided with an opening 32 corresponding to each lamp 24. The hinged door 30 is preferably constructed of a rigid material such as aluminum, steel, or plastic. The hinged door 30 is supported on a first side by the housing by means of a lip 34 on the cover that engages a second lip 36 located along one edge of the open side of the housing 12. The second side of the hinged door 30 is supported on a ledge 38 located on the opposite side of the housing 12. The hinged door 30 is secured to the ledge 38 by at least one screw 40 that is inserted through elongated openings 42 in the hinged door 30. In a preferred embodiment, the housing lip 36 is slightly elongated in order to allow the cover lip 34 and housing lip 36 to mate slideable manner. This arrangement, in combination with the elongated openings 42 in the cover for screws 40, allows the hinged door 30 to slide laterally relative to the housing 12.

The light 10 is provided with a light expanding system that converts the light emitted from the halogen lamps 24 into a "linear" or "planar" "light beam". The light expanding system includes a linear spread lens 44 positioned over the cover openings 32 corresponding to the lamps 24. Preferably, the linear spread lens covers the entire opening 32. The lens 44 spreads the light beam emitted from each lamp 24 evenly across the width of the artwork being illuminated. In the event that multiple lamps 24 are used in the light 10, the lenses 44 associated with each lamp 24 combine to spread and overlap the light beams emitted from each lamp 24, thereby providing even illumination across the entire width of the artwork. The lens 44 includes a flat side 46 and a rippled side 48 that serves the purpose of diffusing emitted light laterally. The rippled side 48 is provided with a plurality of rounded ridges. Linear spread lenses of this nature are well known to those in the art. An example of a suitable lens is a Skytex pattern lens. The lens 44 is mounted over the opening 32 in the hinged door 30 with the rippled side 48 facing outward from the light 10.

Because lamps are generally located adjacent the top of the artwork, there is a tendency in prior art lamps for the emitted light to be more intense at the top of the work and less intense at the bottom. In embodiments of the present invention, the lens 44 is etched to even the light from top to bottom of an artwork. The etching also minimizes any striations in the emitted light that might be introduced by the lens 44. The lens 44 is provided with heavier etching 50 on the side adjacent to the artwork and lighter or no etching 52 on the side farther away from the work. In alternate embodiments, there are more than two sections of etching on each lens 44, each varying in the degree of etching, for example, from lighter to heavier etching. This alternate embodiment allows even finer vertical tuning of the light emitted from the lamps 24.

The ideal positioning of the line of demarcation 54 between heavier and lighter etching of the lens 44 relative to the lamp 24, thereby determining the relative amounts of heavy and light etching, depends on the height of the artwork. For taller artworks, the lighter etching 52 should comprise a greater percentage of the work. For shorter works, it is preferable that the heavier etching 50 comprise more of the surface area of the lens 44. Therefore, it is desirable that the lens 44 be adjustable relative to the lamp 24. The sliding arrangement between the hinged door 30 and the housing 12 described above is a preferred means of providing this adjustability of the lens 44. An alternative method is to mount the lens 44 in variable positions associated with the hinged door 30. The lens 44 may be moved as desired relative to the hinged door opening 32.

In a preferred embodiment, the lens 44 is provided with an ultraviolet filter coating, for example, Optivex® by Bausch & Lomb, to reduce the amount of ultraviolet emission from the lamp 24. Preferably, the ultraviolet filter coating eliminates at least 95% of wavelengths below 400 nanometers. The lens 44 is also provided with a color-correcting tint. The tinting is required to counteract the removal of a portion of the red spectrum from the light emitted by the bulb due to the dichroic coating on the reflector. Without the tinting, light emitted from the light 10 would be slightly greenish in color.

The hinged door 30 covers the open side of the housing 12, thereby controlling the emission of light from the housing 12. In addition, the lens 44 covers the entirety of the hinged door opening 32. Therefore, most, if not all, of the light emitted by the light 10 passes through the lens 44. This arrangement ensures that most of the light emitted has been processed through the heat filtering and light expanding systems of the light.

While the above description has primarily described embodiments of the light 10 having a single lamp 24, lens 44 and hinged door opening 32, it should be understood that the same principles apply to lights incorporating multiple lamps 24 and corresponding lenses 44 and hinged door openings 32.

Other objects, features and advantages of the present invention will be apparent to those skilled in the art. While preferred embodiments of the present invention have been illustrated and described, this has been by way of illustration and the invention should not be limited.

What is claimed is:

1. A lighting system for illuminating artwork, including:

a housing;

a lamp mounted within the housing and including a halogen bulb and a reflector, said reflector having a dichroic coating;

a linear spread lens positioned in front of the lamp and having an etched first portion and lighter etched second portion of a first surface; and a door associated with the housing directing the light emitted by the lighting system through the linear spread lens.

2. A lighting system for illuminating artwork as set forth in claim 1, wherein the linear spread lens is provided with an ultraviolet filter coating.

3. A lighting system for illuminating artwork as set forth in claim 2, wherein the ultraviolet filter coating filters at least 95% of ultraviolet light.

4. A lighting system for illuminating artwork as set forth in claim 1, wherein the linear spread lens is provided with a color-adjusting tint.

5. A lighting system for illuminating artwork as set forth in claim 1, wherein a ratio of the etched first portion to the lighter etched second portion is approximately 50/50.

6. A lighting system for illuminating artwork as set forth in claim 1, wherein a ratio of the etched first portion to the lighter etched second portion is in the range of from about 75/25 to 25/75.

7. A lighting system for illuminating artwork as set forth in claim 1, wherein the linear spread lens is mounted on the door.

8. A lighting system for illuminating artwork as set forth in claim 7, wherein the door is connected in a laterally slideable manner relative to the housing.

9. A lighting system for illuminating artwork as set forth in claim 8, further including a demarcation line between the etched first portion and the lighter etched second portion of the linear spread lens and wherein a position of the demarcation line relative to the lamp is adjusted by the slideable connection between the door and the housing.

10. A lighting system for illuminating artwork as set forth in claim 1, wherein the linear spread lens is provided with a plurality of rounded ridges on a second surface facing away from the lamp.

11. An optical conversion system for an artwork light having a halogen light source, including:

a reflector having a dichroic coating surrounding the halogen light source; and a linear spread lens positioned in front of the halogen light source, said linear spread lens having:

an ultraviolet filter coating;

a color-adjusting tint;

an etched first portion of a first surface; and a lighter etched second portion of the first surface.

12. An optical conversion system for an artwork light as set forth in claim 11, wherein a ratio of the etched first portion to the lighter etched second portion is approximately 50/50.

13. An optical conversion system for illuminating artwork as set forth in claim 11, wherein a ratio of the etched first portion to the lighter etched second portion is in the range of from about 75/25 to 25/75.

14. An optical conversion system for illuminating artwork as set forth in claim 11, further including a demarcation line between the etched first portion and the lighter etched second portion of the lens and wherein a position of the demarcation line relative to the halogen light source is adjustable.

15. A method of lighting both the top and bottom of an artwork, including the steps of:

emitting a beam of light from a halogen bulb;

filtering radiant heat from the beam of light through a reflector surrounding the halogen bulb and having a dichroic coating;

laterally diffusing the beam through a linear spread lens positioned in front of the lamp;

vertically diffusing the beam through an etched first portion and lighter etched second portion of said lens; and adjusting the color of the beam through a tinted coating on the lens.

16. A method of lighting artwork as set forth in claim 15, further including the step of adjusting a position of the first and second portions of the linear spread lens relative to the halogen bulb depending on a height of the artwork.

17. A method of optically correcting a beam of light emitted by a halogen light source for illumination of artwork, including the steps of:

filtering radiant heat from the beam of light through a reflector surrounding the halogen bulb having a dichroic coating;

laterally diffusing the beam through a linear spread lens positioned in front of the lamp;

vertically diffusing the beam through an etched first portion and lighter etched second portion of said lens; and adjusting the color of the beam through a tinted coating on the lens.

18. A method of optically correcting a beam of light emitted by a halogen light source as set forth in claim 17, further including the step of adjusting a position of the first and second portions of the linear spread lens relative to the halogen bulb depending on a height of the artwork.

* * * * *